United States Patent [19]

Dain et al.

[11] 4,224,260

[45] Sep. 23, 1980

[54] PRODUCTION OF METAL POWDER

[75] Inventors: Richard J. Dain, Borough Green; Peter R. Brewin, Weald, both of England

[73] Assignee: Powdrex Limited, London, England

[21] Appl. No.: 11,721

[22] Filed: Feb. 12, 1979

Related U.S. Application Data

[63] Continuation of Ser. No. 789,915, Apr. 22, 1978, abandoned.

[30] Foreign Application Priority Data

Apr. 23, 1976 [GB] United Kingdom ..... 16498/76

[51] Int. Cl.[2] ..... B01J 2/06

[52] U.S. Cl. ..... 264/11

[58] Field of Search ..... 264/11

[56] References Cited

U.S. PATENT DOCUMENTS

| | | | |
|---|---|---|---|
| 3,793,412 | 2/1974 | Shanahan et al. | 264/11 |
| 3,892,834 | 7/1975 | Pritchard | 264/13 |

*Primary Examiner*—Donald J. Arnold
*Assistant Examiner*—James R. Hall
*Attorney, Agent, or Firm*—Blum, Kaplan, Friedman, Silberman & Beran

[57] ABSTRACT

The invention concerns making metal powder by atomizing and quenching a stream of molten metal. According to the invention an anti-foaming agent is included in the atomizing and/or the quenching liquid and this produces more rapid cooling of the metal particles.

9 Claims, No Drawings

PRODUCTION OF METAL POWDER

This is a continuation of application Ser. No. 789,915, filed Apr. 22, 1978, now abandoned.

BACKGROUND OF THE INVENTION

This invention relates to the production of metal powder i.e. metal in powder or particulate form. Metal powder, which is used in powder metallurgical processes, can be produced by "atomizing" molten metal by gas or liquid jets and rapidly quenching the resulting metal droplets.

In convention practice a limitation is imposed on atomizer configuration because the very confined atomization zones which result from attempts to achieve high quality powders by using high quench water levels and short free fall paths lead to excessive generation of foam, especially where anti-oxidants are used in the quench water. An object of the invention is to achieve more efficient cooling of the metal droplets.

SUMMARY OF THE INVENTION

The present invention resides in a method of making metal powder which comprises atomizing a stream of molten metal into metal droplets by impinging jets of liquid and quenching the droplets with further liquid and including the step of including anti-foaming agent in at least some of the liquid to reduce foaming.

The anti-foaming agent may be included in the atomizing jets, or the quenching water or both. Where the atomizing fluid flow is small in comparison to the quench water flow (less than 1/15th) we have found that it is not essential to add anti-foam to the atomizing fluid provided anti-foam is present in the quench fluid.

We have found that it is important that the metal droplets should be frozen, or solidified, quickly on being formed by atomizing the metal stream. If the droplets are not solidified rapidly, large particles or conglomerates of particles are produced by a number of liquid or semi-liquid droplets coalescing, or adhering, together. Secondly, the oxygen content of the particles becomes undesirably high even where the atomization takes place in a closed vessel with a nitrogen through purge because slow cooling increases the absorbtion of oxygen from the environment. Thirdly, the particles tend to have regular and nearer spherical shapes, because slow cooling allows surface tension to be effective to give the particles shapes approaching spheres; we have determined on the other hand that irregularly shaped particles are desirable in that better mechanical keying is achieved when the powder is subject to pressure to form a compact.

By including an anti-foaming agent foaming is minimized around the particles of cooling metal and rapid solidification of the metal droplets is achieved, with the avoidance of the deleterious effects mentioned above. Without the inclusion of the anti-foaming agent in the atomizing liquid, the foaming then occurring at the point of impact results in a low rate of heat transfer from the droplets to the liquid and an undesirably low rate of cooling.

DETAILED DESCRIPTION OF THE INVENTION

When the liquid used for atomizing the metal is water, as is usually the case, it is preferred to employ a silicone anti-foaming agent, such as that sold by Duphar-Midox Ltd. under the trade name (which consists of a water emulsion of 10% Dimethylpolysiloxane fluid and silica water) MIDOX ANTIFOAM in a quantity 100–1000 cubic centimeters per 1,000 gallons of water.

Foaming is reduced to less than 20% and preferably less than 10% that which would occur under the same conditions without an anti-foaming agent.

As an example we maintained in our atomizer quench water a concentration of Duphar-Midox anti-foam of 350 c.c.s. anti-foam to 1,000 gallons demineralized water in the atomizer of High Speed Steel of the following composition besides iron: C 1.2%, W 6.0%, Mo 5%, Cr 4%, Van 2%, Co 5%.

The effect of this was to produce a powder which had an oxygen content below 2500 ppm and of irregularity which, when the powder was blended with 0.75% magnesium stearate and compressed in a die to produce a compact 1" diameter and ½" thickness gave a density of 66% at a pressure of 25 tons/in$^2$.

We claim:

1. A method of making metal powder having a relatively low oxygen content and irregularly shaped particles from molten metal comprising:
   (a) forming a falling stream of molten metal;
   (b) impinging a jet of an atomizing liquid upon the falling metal stream to atomize said molten stream into molten metal droplets;
   (c) quenching said droplets with a quench liquid to rapidly cool and quickly solidify said droplets; and
   (d) including in at least one of the atomizing and quench liquids an anti-foaming agent to reduce foaming around said molten metal droplets and to increase the rate of cooling of said metal droplets.

2. A method of claim 1 wherein said atomizing liquid and said quench liquid are water.

3. The method of claim 2 wherein said anti-foaming agent is a silicone anti-foaming agent.

4. The method of claim 1 wherein said anti-foaming agent is included in the jet of atomizing liquid.

5. The method of claim 1 wherein said anti-foaming agent is included in the quench liquid.

6. The method of claim 1 wherein said anti-foaming agent is included in said jet of atomizing liquid and said quench liquid.

7. The method of claim 3 wherein said silicone anti-foaming agent is included from about 100 to 1,000 cubic centimeters per 1,000 gallons of water.

8. The method of claim 1 wherein foaming is reduced to less than 20% of the foaming which occurs without including said anti-foaming agent.

9. The method of claim 1 wherein foaming is reduced to less than 10% of the foaming which would occur without including the anti-foaming agent.

* * * * *